US009659525B2

(12) United States Patent
In et al.

(10) Patent No.: US 9,659,525 B2
(45) Date of Patent: May 23, 2017

(54) DISPLAY DEVICE

(71) Applicant: SAMSUNG DISPLAY CO., LTD., Yongin, Gyeonggi-Do (KR)

(72) Inventors: Hai-Jung In, Yongin (KR); Dong-Gyu Kim, Yongin (KR); Jung-Bae Kim, Yongin (KR); Yong-Sung Park, Yongin (KR); Bo-Yong Chung, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 27 days.

(21) Appl. No.: 14/737,883

(22) Filed: Jun. 12, 2015

(65) Prior Publication Data

US 2016/0012768 A1 Jan. 14, 2016

(30) Foreign Application Priority Data

Jul. 8, 2014 (KR) ..... 10-2014-0085398

(51) Int. Cl.
*G09G 5/00* (2006.01)
*G09G 3/3225* (2016.01)

(52) U.S. Cl.
CPC ..... *G09G 3/3225* (2013.01); *G09G 2300/043* (2013.01); *G09G 2300/0426* (2013.01); *G09G 2320/0223* (2013.01); *G09G 2320/0233* (2013.01); *G09G 2330/00* (2013.01)

(58) Field of Classification Search
CPC ..... G09G 2300/0421; G09G 2300/043; G09G 2300/0426; G09G 2320/045
See application file for complete search history.

(56) References Cited

U.S. PATENT DOCUMENTS 8,149,230 B2 * 4/2012 Lee ..... G02F 1/136286 345/211
8,279,206 B2 * 10/2012 Ryu ..... G06F 3/14 326/30
8,547,309 B2 * 10/2013 Byun ..... G09G 3/3233 315/169.3
9,368,060 B2 * 6/2016 Chae ..... G09G 3/3225
2003/0222840 A1 * 12/2003 Koga ..... G09G 3/3696 345/89
2005/0140306 A1 6/2005 Park
2005/0264510 A1 * 12/2005 Shimatani ..... G09G 3/3688 345/94

(Continued)

FOREIGN PATENT DOCUMENTS

KR 10-2005-0065947 6/2005
KR 10-2006-0053463 A 5/2006

(Continued)

*Primary Examiner* — Kent Chang
*Assistant Examiner* — William Lu
(74) *Attorney, Agent, or Firm* — Lee & Morse, P.C.

(57) ABSTRACT

A display device includes a display panel, a data driver, a scan driver, and a power supply. The display panel includes power voltage lines and pixels coupled to data lines and scan lines. The data driver supplies data voltages to the data lines. The scan driver provides scan signals to the scan lines. The power supply supplies a power voltage to the power voltage lines. The display panel includes a compensation resistance coupled between s pixels and one of the power voltage lines.

18 Claims, 7 Drawing Sheets

(56) References Cited

U.S. PATENT DOCUMENTS

| | | | | |
|---|---|---|---|---|
| 2006/0044237 | A1* | 3/2006 | Lee | G09G 3/3233 345/82 |
| 2006/0158397 | A1* | 7/2006 | Goh | G09G 3/3233 345/76 |
| 2006/0158402 | A1* | 7/2006 | Nathan | G09G 3/3233 345/82 |
| 2008/0174577 | A1* | 7/2008 | Fujita | G09G 3/3677 345/204 |
| 2008/0180364 | A1 | 7/2008 | Kim | |
| 2008/0225036 | A1* | 9/2008 | Song | G09G 3/3611 345/213 |
| 2011/0115764 | A1 | 5/2011 | Chung | |
| 2011/0248977 | A1* | 10/2011 | Li | G09G 3/20 345/211 |
| 2012/0050344 | A1 | 3/2012 | Kim et al. | |
| 2012/0092308 | A1* | 4/2012 | Chiang | G02F 1/1345 345/204 |
| 2012/0280970 | A1* | 11/2012 | Kato | G09G 3/3291 345/212 |
| 2012/0306826 | A1* | 12/2012 | Tsuchi | G09G 3/006 345/204 |

FOREIGN PATENT DOCUMENTS

| | | |
|---|---|---|
| KR | 10-2008-0070381 | 7/2008 |
| KR | 10-2011-0053709 | 5/2011 |
| KR | 10-2012-0019016 | 3/2012 |

* cited by examiner

DISPLAY DEVICE

CROSS-REFERENCE TO RELATED APPLICATION

Korean Patent Application No. 10-2014-0085398, filed on Jul. 8, 2014, and entitled: "Display Device," is incorporated by reference herein in its entirety.

BACKGROUND

1. Field

One or more embodiments described herein relate to a display device.

2. Description of the Related Art

Various types of flat panel displays have been developed. Examples include liquid crystal displays, plasma displays, and organic light emitting diode (OLED) displays.

OLED displays include a display panel, a data driver, and a scan driver. The display panel has pixels at intersections between data lines and scan lines. The data driver supplies data voltages to the data lines, and the scan driver provides scan signals to the scan lines. The display panel also includes a power supply unit to one or more supply power voltages. When a scan signal is provided, each of the pixels controls current from a power voltage line to the OLED depending on a data voltage supplied through the data line. As a result, the OLED emits light with a predetermined level of luminance.

Because the first power voltage line which supplies the power voltage is coupled to the pixels, the power voltage drops due to IR drop when current is supplied to the pixels. That is, the IR drop causes a difference between the power voltage supplied to the pixels coupled to the first scan line and the power voltage supplied to the pixels coupled to an i-th scan line. Consequently, luminance varies depending on positions of the pixels, e.g., long range uniformity (LRU) becomes low.

SUMMARY

In accordance with one embodiment, a display device includes a display panel including power voltage lines and pixels coupled to data lines and scan lines; a data driver to supply data voltages to the data lines; a scan driver to provide scan signals to the scan lines; and a power supply to supply a power voltage to the power voltage lines, wherein the display panel includes a compensation resistance coupled between s pixels and one of the power voltage lines, where s≥2.

Each of the pixels may include a driving transistor to control current from a first electrode to a second electrode depending on a voltage of a control electrode; a scan transistor to turn on in response to the scan signal of each of the scan lines, and to supply the data voltage of each of the data lines to the control electrode of the driving transistor; an organic light emitting diode to emit light depending on a current controlled by the driving transistor; and a capacitor coupled between the control electrode of the driving transistor and the first electrode.

The compensation resistance may be coupled between one of the power voltage lines and the first electrode of the driving transistor in each of the s pixels. The s pixels may be adjacent to each other in a first direction of the scan lines. The compensation resistances adjacent to each other in a second direction of the data lines may be coupled to different ones of the power voltage lines. The s pixels may be adjacent to each other in a second direction of the data lines. The compensation resistances adjacent to each other in the first direction of the scan lines may be coupled to different power voltage lines.

The s pixels may include pixels adjacent to each other in the first direction of the scan lines; and pixels adjacent to each other in the second direction of the data lines. The s pixels may be arranged in a substantially rectangular shape.

A predetermined number of compensation resistances may be coupled between corresponding ones of a plurality of groups of s pixels and corresponding ones of power voltage lines, and the predetermined number may be less than all the compensation resistances. Compensation resistances nearer to start points of the power voltage lines may be coupled between corresponding ones of the groups of s pixels and corresponding ones of the power voltage lines, and each of the compensation resistances nearer to end points of the power voltage lines may be coupled between one pixel and a corresponding one of the first power voltage lines.

A point nearer to a start point of the one of the power voltage lines may have a first number of the pixels coupled to the compensation resistance, a point nearer to an end point of the power voltage line may have a second number of the pixels coupled to the compensation resistance, and the first number may be greater than the second number.

The display device may include a mesh line connecting first electrodes of driving transistors of the s pixels coupled to the compensation resistance to first electrodes of driving transistors of s pixels coupled to another compensation resistance.

In accordance with another embodiment, a display device includes a power line; a first number of pixels; a second number of pixels; a first compensation resistance coupled between a light emitter of each of the first number of pixels and the power line; and a second compensation resistance coupled between a light emitter of each of the second number of pixels and the power line, wherein the first compensation resistance is greater than the second compensation resistance, and wherein the second compensation resistance is farther away from a start point of the power line than the first compensation resistance.

A voltage of an output terminal of the first compensation resistance may be substantially equal to a voltage of an output terminal of the second compensation resistance. The first number of pixels may be different from the second number of pixels. The first and second numbers of pixels may be in a same row. The first and second numbers of pixels may be in a same column. A same current may flow through the first and second compensation resistances. Each of the first and second compensation resistances may include at least one resistor.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
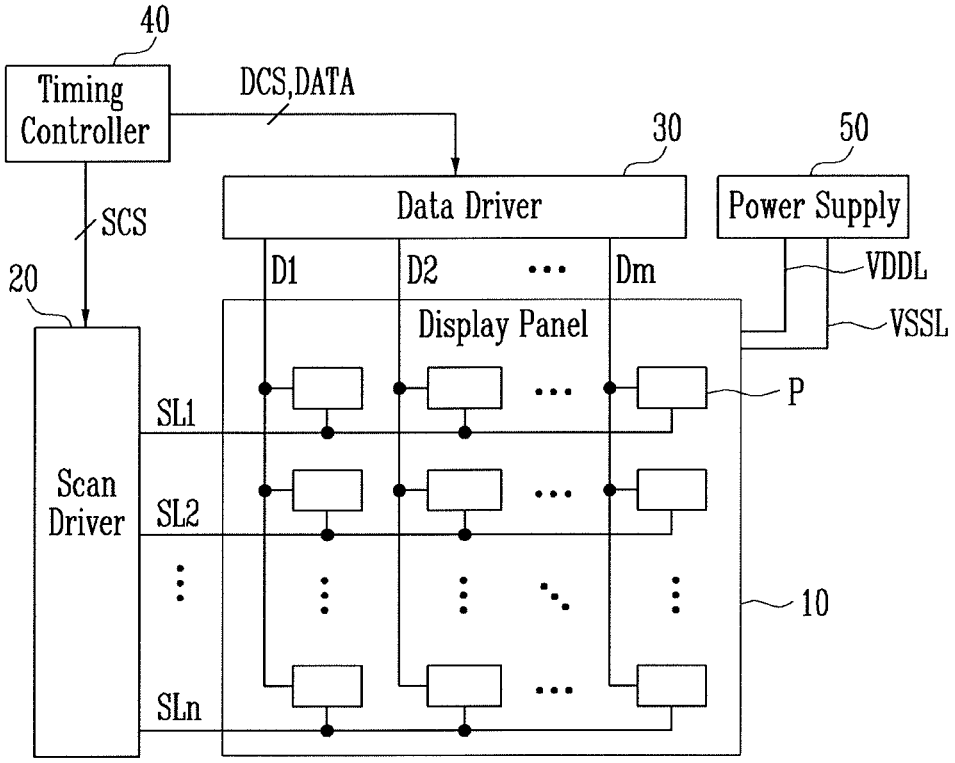
FIG. 1 illustrates an embodiment of a display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Also, in the drawings, the dimensions of various features may be exaggerated for clarity of illustration. Like reference numerals refer to like elements throughout.

FIG. 1 illustrates an embodiment of a display device 1 which includes a display panel 10, a scan driver 20, a data driver 30, a timing controller 40, and a power supply unit 50. The display panel 10 includes data lines D1 to Dm (m is a positive integer of two or more) and scan lines S1 to Sn (n is a positive integer of two or more) that intersect each other. Pixels P are arranged in a matrix form at intersections of the data lines D1 to Dm and the scan lines S1 to Sn. A first power voltage line VDDL and a second power voltage line VSSL are coupled to the display panel 10.

Each pixel P is coupled to one scan line and one data line, and is supplied with a data voltage via the data line when a scan signal is provided to the scan line. Each pixel P emits light with a predetermined level of luminance, by controlling a current that flows from the first power voltage line to the OLED depending on a data voltage.

The data lines D1 to Dm, the scan lines S1 to Sn, the first power voltage line VDDL, and the pixels P of the display panel 10 are described in detail with reference to FIGS. 2 to 7.

The scan driver 20 receives a scan timing control signal SCS from the timing controller 40. The scan driver 20 generates scan signals in response to the scan timing control signal SCS. The scan driver 20 provides scan signals to the scan lines S1 to Sn.

The data driver 30 includes at least one source drive IC. The source drive IC receives digital video data DATA and a source timing control signal DCS from the timing controller 40. The source drive IC responds to the source timing control signal DCS, and then converts the digital video data DATA into data voltages. The source drive IC is synchronized with each of the scan signals, and then supplies data voltages to the data lines D1 to Dm. Thus, the data voltages are supplied to the pixels P to which the scan signal is provided.

The timing controller 40 receives the digital video data DATA and the timing signals from an external source. The timing signals may include, for example, a vertical sync signal, a horizontal sync signal, a data enable signal, and a dot clock. The timing controller 40 generates timing control signals to control the operation timing of the data driver 20 and the scan driver 30. The timing control signals include a scan timing control signal SCS for controlling the operation timing of the scan driver 30, and a data timing control signal DCS for controlling the operation timing of the data driver 20. The timing controller 40 outputs the scan timing control signal SCS to the scan driver 30, and outputs the data timing control signal DCS and the digital video data DATA to the data driver 20.

The power supply unit 50 supplies a first power voltage through the first power voltage line VDDL, and supplies a second power voltage through the second power voltage line VSSL. The first power voltage line VDDL is coupled to the pixels P of the display panel 10 to supply the first power voltage. The second power voltage line VSSL is coupled to cathode electrodes of the OLEDs of the pixels P of the display panel 10, to thereby supply the second power voltage. The first power voltage may be set, for example, to a high-potential voltage and the second power voltage may be set to a low-potential voltage, or vice versa.

Figure 2:
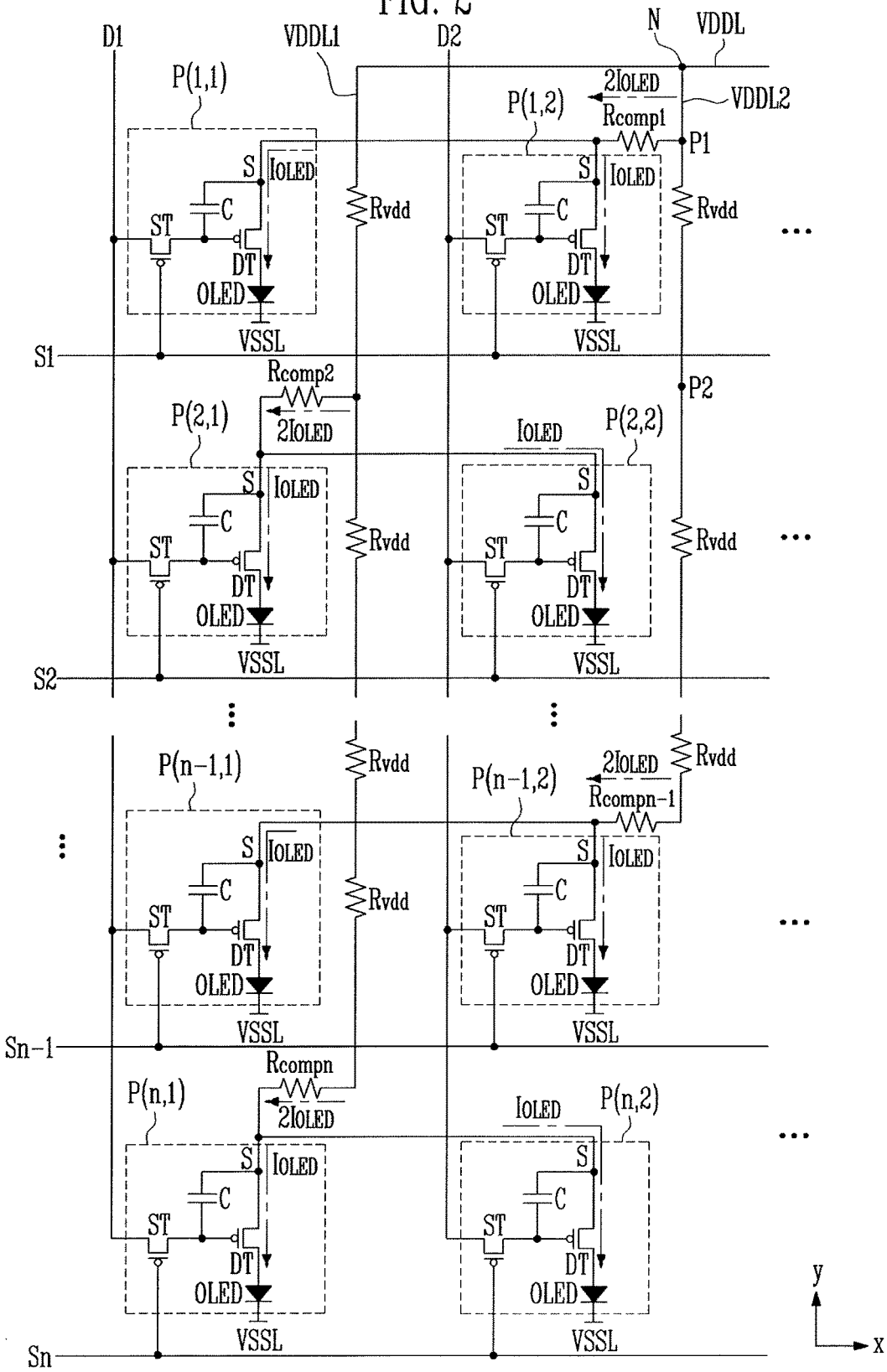
FIG. 2 illustrates a first embodiment of a display panel.

FIG. 2 illustrates a first embodiment of the display panel. For convenience of description, FIG. 2 shows only a first, second, (n−1)-th and n-th scan lines S1, S2, Sn−1 and Sn, first and second data lines D1 and D2, a power voltage line VDDL which branches at node N to first power voltage lines VDDL1 and VDDL2, a first, second, (n−1)-th and n-th compensation resistances Rcomp1, Rcomp2, Rcompn−1 and Rcompn, and the pixels P. The scan lines S1, S2, Sn−1 and Sn extend in a first direction (x-axis direction), and the data lines D1 and D2 extend in a second direction (y-axis direction). Thus, the scan lines S1, S2, Sn−1 and Sn intersect the data lines D1 and D2.

The first power voltage lines VDDL1 and VDDL2 extend in the second direction (y-axis direction). However, the first power voltage lines VDDL1 and VDDL2 may extend in the first direction (x-axis direction) in other embodiments. The first power voltage lines VDDL1 and VDDL2 are coupled to the pixels P.

Each pixel P includes a driving transistor DT, an OLED, a scan transistor ST, and a capacitor C. The driving transistor DT controls current from a first electrode to a second electrode depending on a voltage of the control electrode. The control electrode of the driving transistor DT is coupled to the second electrode of the scan transistor ST, the first electrode is coupled to one of the first power voltage lines VDDL1 or VDDL2, and the second electrode is coupled to an anode electrode of the OLED. The control electrode may be a gate electrode, the first electrode may be a source electrode or a drain electrode, and the second electrode may be an electrode different from the first electrode. For example, if the first electrode is the source electrode, the second electrode may be the drain electrode.

The OLED emits light in proportion to the current controlled by the driving transistor DT. The OLED has an anode electrode coupled to the second electrode of the driving transistor DT and a cathode electrode coupled to the low-potential voltage line VSSL.

The scan transistor ST is coupled between a j-th data line and the control electrode of the driving transistor DT. The scan transistor ST is turned on in response to the scan signal of a k-th scan line, to thereby supply the data voltage of the j-th data line to the control electrode of the driving transistor DT. The control electrode of the driving transistor DT is coupled to the k-th scan line, the first electrode is coupled to the j-th data line. The second electrode is coupled to the control electrode of the driving transistor DT. The scan transistor ST and the driving transistor DT may be formed as a PMOSFET or an NMOSFET.

The capacitor C is coupled between the control electrode of the driving transistor DT and the first electrode. The capacitor C maintains the voltage of the control electrode of the driving transistor DT for a predetermined period of time.

The compensation resistances Rcomp1, Rcomp2, Rcompn−1, and Rcompn are respectively coupled between s pixels P and the first power voltage line VDDL, where s≥2. Particularly, the compensation resistances Rcomp1, Rcomp2, Rcompn−1, and Rcompn are respectively coupled to the first electrodes (source node S) of the driving transistors of s pixels P.

In the first embodiment, the compensation resistances Rcomp1, Rcomp2, Rcompn−1, and Rcompn are respectively coupled between the s pixels P adjacent to each other in the first direction (x-axis direction) and respective ones of the first power voltage lines VDDL1 and VDDL2. For example, the compensation resistances Rcomp1, Rcomp2, Rcompn−1, and Rcompn may be respectively coupled between two pixels P adjacent to each other in the first direction (x-axis direction) and respective ones of the first power voltage lines VDDL1 and VDDL2, as shown in FIG. 2.

According to this arrangement, the first compensation resistance Rcomp1 is coupled between two pixels P(1,1) and P(1,2) adjacent to each other in the first direction (x-axis direction) and the first power voltage line VDDL2, as shown in FIG. 2. The second compensation resistance Rcomp2 is coupled between two pixels P(2,1) and P(2,2) adjacent to each other in the first direction (x-axis direction) the first power voltage line VDDL1. The two pixels P(1,1) and P(1,2) are coupled to the first compensation resistance Rcomp1 and to the first scan line S1. The two pixels P(2,1) and P(2,2) are coupled to the second compensation resistance Rcomp2 and to the second scan line S2.

Further, s compensation resistances adjacent to each other in the second direction (y-axis direction) are coupled to different ones of the first power voltage lines VDDL1 and VDDL2. For example, as shown in FIG. 2, two compensation resistances adjacent to each other in the second direction (y-axis direction), namely, the first compensation resistance Rcomp1 and the second compensation resistance Rcomp2, are coupled to different ones of the first power voltage lines VDDL1 and VDDL2. For example, the first compensation resistance Rcomp1 may be coupled to the first power voltage line VDDL2 on the right side (or the left side) of the two pixels P(1,1) and P(1,2). The second compensation resistance Rcomp2 may be coupled to the first power voltage line VDDL1 between the two pixels P(2,1) and P(2,2).

Because a wiring resistance is present in the first power voltage lines VDDL1 and VDDL2, an IR drop of the first power voltage resulting from the wiring resistance causes a difference between the first power voltage supplied to the pixels P coupled to the k-th scan line Sk and the first power voltage supplied to the pixels P coupled to the (k+1)-th scan line Sk+1. For example, it is assumed that the wiring resistance between a first point Pk of the first power voltage line corresponding to the pixel P coupled to the k-th scan line Sk and a (k+1)-th point Pk+1 of the first power voltage line corresponding to the pixel P coupled to the (k+1)-th scan line Sk+1 is Rvdd, where the first power voltage is ELVDD. For example, the voltage of the first point P1 of the first power voltage line VDDL2 is ELVDD, and the voltage of the second point P2 is ELVDD−((n−2)×IOLED×Rvdd).

As a result, the first power voltage is reduced from a start point to an end point of first power voltage line VDDL2 due to the IR drop. For example, the start point of the first power voltage line VDDL2 denotes a point nearest to the power supply unit 50 (or branch node N), and the end point of the first power voltage line VDDL2 denotes a point farthest from the power supply unit 50. In other embodiments, these points may be located at different positions.

According to the first embodiment, in order to prevent the voltage of the source electrode of the driving transistor DT of each pixel P from changing due to the IR drop of the first power voltage, compensation resistances are formed between the pixels P and the first power voltage lines VDDL1 and VDDL2. In this embodiment, points nearer to the start points (e.g., branch node N) of each first power voltage line have smaller IR drops of the first power voltage. Hence, points nearer to the start points of the first power voltage lines VDDL1 and VDDL2 have larger compensation resistances.

Conversely, points nearer to the end points of the first power voltage lines VDDL1 and VDDL2 have larger IR drops of the first power voltage. Hence, points nearer to the end points of the first power voltage lines VDDL1 and VDDL2 have smaller compensation resistances. Thus, in the first embodiment, the compensation resistance is larger at points closer to the start points of the first power voltage lines VDDL1 and VDDL2. This may reduce or prevent the luminance of the pixels from being non-uniform due to the IR drop of the first power voltage.

For example, the voltage of the source node S of each of the two pixels P(1,1) and P(1,2) coupled to the first scan line S1 is ELVDD−(2×IOLED×Rcomp1). The voltage of the source node S of each of the two pixels P(2,1) and P(2,2) coupled to the second scan line S2 is ELVDD−(n×IOLED×Rvdd)−(2×IOLED×Rcomp2). The voltage of the source node S of each of the pixels P(1,2) and P(2,2) coupled to the first scan line S1, and the voltage of the source node S of each of the pixels P(1,1) and P(2,1) coupled to the second scan line S2, may be substantially equal to each other. Thus, the resistance Rcomp1 is larger than the resistance Rcomp2. That is, because the resistance Rcomp1 is coupled nearer to the start point of the first power voltage line VDDL2 compared to the resistance Rcomp2 (e.g., relative to branch node N or power supply unit 50), the resistance Rcomp1 is larger than the resistance Rcomp2.

Referring to FIG. 2, in each pixel P, the current IOLED flows through the driving transistor DT to the OLED. A current s×IOLED flows in the compensation resistances Rcomp1, Rcomp2, Rcompn−1 and Rcompn. The current s×IOLED is distributed to each of the pixels P. For example, as shown in FIG. 2, the current 2×IOLED flows in the compensation resistance Rcomp1 coupled to the two pixels P(1,1) and P(1,2). The current 2×IOLED is distributed to each of the two pixels P(1,1) and P(1,2).

If each compensation resistance Rcomp1, Rcomp2, Rcompn−1 and Rcompn is coupled between one pixel P and a first power voltage VDDL, the current IOLED flows in each of the compensation resistances Rcomp1, Rcomp2. Rcompn−1, and Rcompn.

In accordance with the first embodiment, the case where each of the compensation resistances Rcomp1, Rcomp2, Rcompn−1 and Rcompn is coupled between a plurality of pixels P and a first power voltage may be referred to as the compensation resistance of the first embodiment. The case where each of the compensation resistances Rcomp1, Rcomp2, Rcompn−1 and Rcompn is coupled between one pixel P and a first power voltage may be referred to as the compensation resistance of a comparative example.

For example, the compensation resistance of the first embodiment may be smaller than that of the comparative example by about 1/s. Further, the compensation resistance of the first embodiment may be formed in the area of the s pixels P, where the compensation resistance of the comparative example may be formed in the area of one pixel P. Thus, the compensation resistance per unit pixel P according to the first embodiment may be smaller than the compensation resistance per unit pixel P according to the comparative example by about 1/s2. Thus, according to the first embodiment, it is possible to reduce the compensation resistance formed in the pixel P, and to thereby allow the pixel P to be easily implemented even when the display device is formed to have high resolution.

Figure 3:
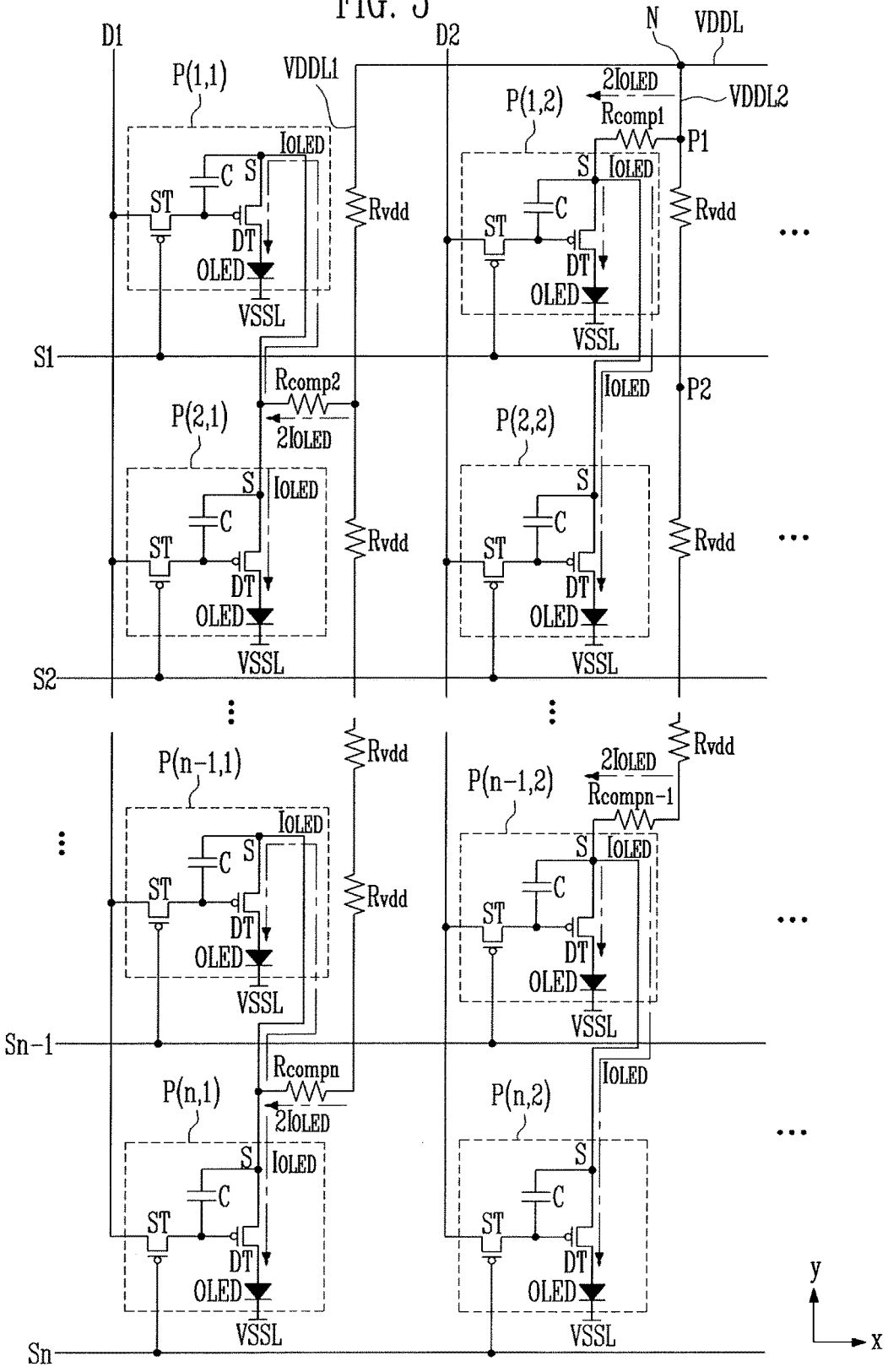
FIG. 3 illustrates a second embodiment of a display panel.

FIG. 3 illustrates a second embodiment of a display panel. For convenience of description, FIG. 3 shows only first, second. (n−1)-th and n-th scan lines S1, S2, Sn−1 and Sn, first and second data lines D1 and D2, at power voltage line VDDL which branches into first power voltage lines VDDL1 and VDDL2 at node N, and first, second, (n−1)-th and n-th compensation resistances Rcomp1, Rcomp2, Rcompn−1 and Rcompn, and pixels P.

The first, second, (n−1)-th and n-th scan lines S1, S2, Sn−1 and Sn, the first and second data lines D1 and D2, the first power voltage lines VDDL1 and VDDL2, and the pixels P of the second embodiment may be the same as the first, second, (n−1)-th and n-th scan lines S1, S2, Sn−1 and Sn, the first and second data lines D1 and D2, the first power voltage lines VDDL1 and VDDL2, and the pixels P of the first embodiment.

The compensation resistances Rcomp1, Rcomp2, Rcompn−1 and Rcompn are respectively coupled between the s pixels P and corresponding ones of the first power voltage lines VDDL1 and VDDL2, where s≥2. For example, the compensation resistances Rcomp1, Rcomp2, Rcompn−1 and Rcompn are respectively coupled to first electrodes (source node S) of driving transistors of the s pixels P.

Further, in the second embodiment, the compensation resistances Rcomp1, Rcomp2, Rcompn−1 and Rcompn are respectively coupled between the s pixels P adjacent to each other in the second direction (y-axis direction) and corresponding ones of the first power voltage lines VDDL1 and VDDL2. For example, as shown in FIG. 3, the compensation resistances Rcomp1, Rcomp2, Rcompn−1 and Rcompn are coupled between two pixels P adjacent to each other in the second direction (y-axis direction) and corresponding ones of the first power voltage lines VDDL1 and VDDL2.

Thus, as shown in FIG. 3, the first compensation resistance Rcomp1 is coupled between two pixels P(1,2) and P(2,2) adjacent to each other in the second direction (y-axis direction) and a the first power voltage lines VDDL2. The second compensation resistance Rcomp2 is coupled between two pixels P(1,1) and P(1,2) adjacent to each other in the second direction (y-axis direction) and the first power voltage line VDDL1. The two pixels P(1,2) and P(2,2) are coupled to the first compensation resistance Rcomp1 are coupled to the second data line D2, and the two pixels P(1,1) and P(1,2) are coupled to the second compensation resistance Rcomp2 may be coupled to the first data line D1.

The s compensation resistances adjacent to each other in the first direction (x-axis direction) are coupled to different ones of the first power voltage lines VDDL1 and VDDL2. For example, as shown in FIG. 3, two compensation resistances adjacent to each other in the first direction (x-axis direction), namely, the first compensation resistance Rcomp1 and the second compensation resistance Rcomp2, are coupled to different ones of the first power voltage lines VDDL1 and VDDL2. For example, the first compensation resistance Rcomp1 are coupled to the first power voltage line VDDL2 formed on a side (e.g. a right side) of the two pixels P(1,2) and P(2,2). The second compensation resistance Rcomp2 are coupled to the first power voltage line VDDL1 formed on a side (e.g. a right side) of the two pixels P(1,1) and P(1,2).

Further, because a wiring resistance is present in each of the first power voltage lines, a difference between the first power voltage supplied to the pixels P coupled to the k-th scan line Sk and the first power voltage supplied to the pixels P coupled to the (k+1)-th scan line Sk+1 is caused by the IR drop of the first power voltage resulting from the wiring resistance. For example, it is assumed that the a wiring resistance between a first point Pk of the first power voltage line VDDL corresponding to the pixel P coupled to the k-th scan line Sk and a (k+1)-th point Pk+1 of the first power voltage line corresponding to the pixel P coupled to the (k+1)-th scan line Sk+1 is Rvdd. The first power voltage is ELVDD. In this case, the voltage of the first point P1 of the first power voltage line VDDL2 is ELVDD, and the voltage of the second point P2 is ELVDD−((n−2)×IOLED×Rvdd).

Thus, the first power voltage is reduced from the start points of the first power voltage lines to the end points thereof due to the IR drop. (A start point of a first power voltage line VDDL denotes a point nearest to branch node N or the power supply unit 50, and an end point of a first power voltage line denotes a point farthest from branch node N or the power supply unit 50).

According to the second embodiment, in order to prevent the voltage of the source electrode of the driving transistor DT of each of the pixels P from being changed due to the IR drop of the first power voltage, the compensation resistance is generated between the pixels P and a corresponding first power voltage line. Points nearer to the start points of the first power voltage lines have smaller the IR drops of the first power voltage. Hence, points nearer the start points of the first power voltage lines have larger the compensation resistances.

Conversely, points nearer to the end points of the first power voltage lines have larger IR drops of the first power voltage. Hence, points nearer to the end points of the first power voltage lines have smaller compensation resistances. Thus, the second embodiment is designed such that points nearer to the start point of the first power voltage lines have larger compensation resistances. This may reduce or prevent the luminance of the pixels from being non-uniform due to the IR drop of the first power voltage.

For example, the voltage of the source node S of each of the two pixels P(1,2) and P(2,2) coupled to the second data line D2 is ELVDD−(2×IOLED×Rcomp1). The voltage of the source node S of each of the two pixels P(1,1) and P(2,1) coupled to the first data line D1 is ELVDD−(n×IOLED×Rvdd)−(2×IOLED×Rcomp2). The voltage of the source node S of each of the pixels P(1,2) and P(2,2) coupled to the second data line D2 and the voltage of the source node S of each of the pixels P(1,1) and P(2,1) coupled to the first data line D1 may be substantially equal. Thus, the resistance Rcomp1 is larger than the resistance Rcomp2. Thus, because the resistance Rcomp1 is coupled to be nearer to the start point (e.g., brank node N or power supply unit 50) of the first power voltage line VDDL2 compared to the resistance Rcomp2, the resistance Rcomp1 is larger than the resistance Rcomp2.

Referring to FIG. 3, in each pixel P, the current IOLED flows through the driving transistor DT to the OLED. As a result, the current s×IOLED flows in the compensation resistances Rcomp1, Rcomp2, Rcompn−1, and Rcompn. The current s×IOLED is distributed to each of the pixels P. For example, as shown in FIG. 3, the current 2×IOLED flows in the compensation resistance Rcomp1 coupled to the two pixels P(1,1) and P(1,2) coupled to the first data line D1. Further, the current 2×IOLED is distributed to each of the two pixels P(1,1) and P(2,1) coupled to the first data line D1.

If each of the compensation resistances Rcomp1, Rcomp2, Rcompn−1, and Rcompn is coupled between one pixel P and the first power voltage VDDL, the current IOLED flows in each of the compensation resistances Rcomp1, Rcomp2, Rcompn−1, and Rcompn. Hereinafter, for convenience of description, the case where each of the compensation resistances Rcomp1, Rcomp2, Rcompn−1, and Rcompn is coupled between a plurality of pixels P and a first power voltage is referred to as the compensation resistance of the second embodiment. The case where each of the compensation resistances Rcomp1, Rcomp2, Rcompn−1, and Rcompn is coupled between one pixel P and a first power voltage is referred to as the compensation resistance of a comparative example.

Thus, the compensation resistance of the second embodiment may be smaller than that of the comparative example by about 1/s. Further, the compensation resistance of the second embodiment may be formed in the area of the s pixels P, where the compensation resistance of the comparative example is formed in the area of one pixel P. Thus, the compensation resistance per unit pixel P according to the second embodiment may be smaller than the compensation resistance per unit pixel P according to the comparative example by about 1/s2.

Thus, in the second embodiment, it is possible to reduce compensation resistance in the pixels P, to thereby allow the pixels P to be easily implemented even when the display device is formed to have high resolution.

Figure 4:
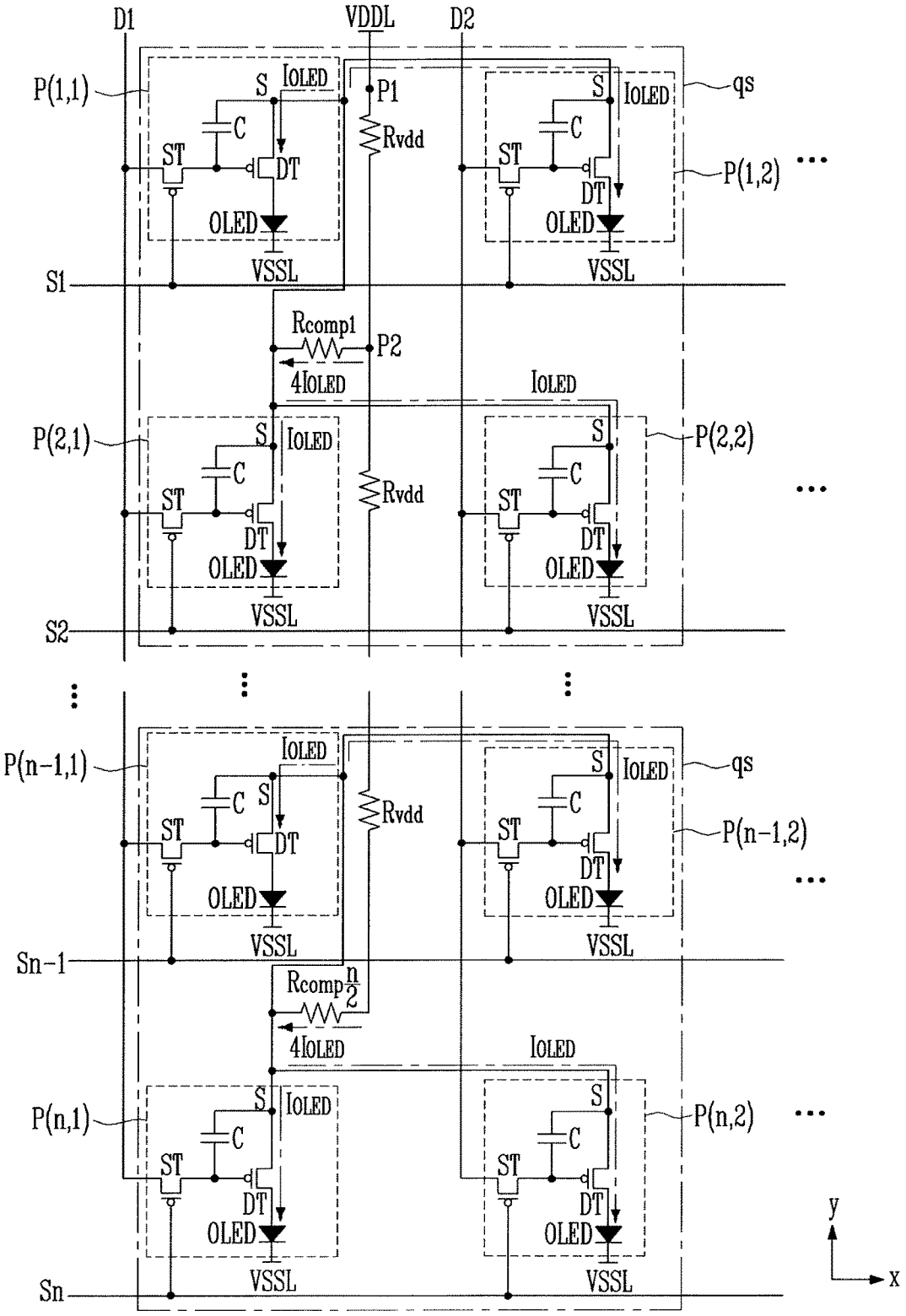
FIG. 4 illustrates a third embodiment of a display panel.

FIG. 4 illustrates a third embodiment of a display panel. For convenience of description, FIG. 4 shows only first, second, (n−1)-th and n-th scan lines S1, S2, Sn−1 and Sn, first and second data lines D1 and D2, a power voltage line VDDL, first and second compensation resistances Rcomp1 and Rcompn/2, and pixels P.

The first, second. (n−1)-th and n-th scan lines S1, S2, Sn−1 and Sn, the first and second data lines D1 and D2, the power voltage line VDDL, and the pixels P according to the third embodiment in FIG. 4 may be the same as the first, second, (n−1)-th and n-th scan lines S1, S2, Sn−1 and Sn, the first and second data lines D1 and D2, the power voltage line VDDL, and the pixels P according to the first embodiment.

The compensation resistances Rcomp1 and Rcompn/2 are coupled between the s pixels P and the power voltage line VDDL, where s≥4. For example, the compensation resistances Rcomp1 and Rcompn/2 are coupled to first electrodes (source node S) of driving transistors of the s pixels P.

In the third embodiment, each of the compensation resistances Rcomp1 and Rcompn/2 is coupled between s pixels P adjacent to each other in the first direction (x-axis direction) and in the second direction (y-axis direction) and the power voltage line VDDL. For example, the s pixels P coupled to each of the compensation resistances Rcomp1 and Rcompn/2 are arranged to form a rectangular shape. Each of the compensation resistances Rcomp1 and Rcompn/2 is coupled between four pixels P forming the rectangular shape qs (as shown in FIG. 4) and the power voltage line VDDL.

According to this arrangement, the first compensation resistance Rcomp1 is coupled between the four pixels P(1,1), P(1,2), P(2,1) and P(2,2) forming the rectangular shape qs (as shown in FIG. 4) and the power voltage line VDDL. Further, an n/2 compensation resistance Rcompn/2 is coupled between the four pixels P(n−1,1), P(n−1,2). P(n,1) and P(n,2) forming the rectangular shape qs (as shown in FIG. 4) and the power voltage line VDDL.

Further, because a wiring resistance is present in the power voltage line VDDL, a difference between the first power voltage supplied to the pixels P coupled to the k-th scan line Sk and the first power voltage supplied to the pixels P coupled to the (k+1)-th scan line Sk+1 is caused by the IR drop of the first power voltage resulting from the wiring resistance. Thus, the first power voltage is reduced from the start point of the power voltage line VDDL to the end point thereof due to the IR drop. The start point of the power voltage line VDDL denotes a point nearest to the power supply unit 50, and the end point of the power voltage line VDDL denotes a point farthest from the power supply unit 50.

In order to prevent the voltage of the source electrode of the driving transistor DT of each of the pixels P from changing due to the IR drop of the first power voltage, the compensation resistance is generated between the pixels P and the power voltage line VDDL. In the third embodiment, points nearer to the start point of the power voltage line VDDL, have smaller IR drops of the first power voltage. Hence, points nearer to the start point of the power voltage line VDDL have larger compensation resistances. Conversely, points nearer to the end point of the power voltage line VDDL have larger IR drops of the first power voltage. Hence, points nearer to the end point of the power voltage line VDDL have smaller compensation resistances.

Thus, the third embodiment is designed such that points nearer to the start point of the power voltage line VDDL have larger compensation resistances. This may reduce or prevent the luminance of the pixels from being non-uniform due to the IR drop of the first power voltage.

Referring to FIG. 4, in each pixel P, a current IOLED flows through the driving transistors DT to the OLED. In this case, a current s×IOLED flows in a corresponding one of the compensation resistances Rcomp1 and Rcompn/2. The current s×IOLED is distributed to each of the pixels P. For example, the current 4×IOLED flows in the compensation resistance Rcomp1 coupled to the four pixels P(1,1), P(1,2), P(2,1) and P(2,2) forming the rectangular shape shown in FIG. 4. Further, the current 4×IOLED is distributed to each of the four pixels P(1,1), P(1,2), P(2,1) and P(2,2) forming the rectangular shape.

If each of the compensation resistances Rcomp1 and Rcompn/2 is coupled between one pixel P and the power voltage VDDL, the current IOLED flows in each of the compensation resistances Rcomp1 and Rcompn/2. (For convenience of description, the case where each of the compensation resistances Rcomp1 and Rcompn/2 is coupled between a plurality of pixels P and the power voltage VDDL is referred to as the compensation resistance of the third embodiment. The case where each of the compensation resistances Rcomp1 and Rcompn/2 is coupled between one pixel P and the power voltage VDDL is referred to as the compensation resistance of a comparative example.)

The compensation resistance of the third embodiment is smaller than that of the comparative example by about 1/s. Further, the compensation resistance of the third embodiment is formed in the area of the s pixels P, where the compensation resistance of the comparative example is formed in the area of one pixel P. Thus, the compensation resistance per unit pixel P according to the third embodiment is smaller than the compensation resistance per unit pixel P according to the comparative example by about 1/s2. Thus, according to the third embodiment, it is possible to reduce the compensation resistance formed in the pixel P, to thereby allow the pixel P to be easily implemented even when the display device is formed to have high resolution.

Figure 5:
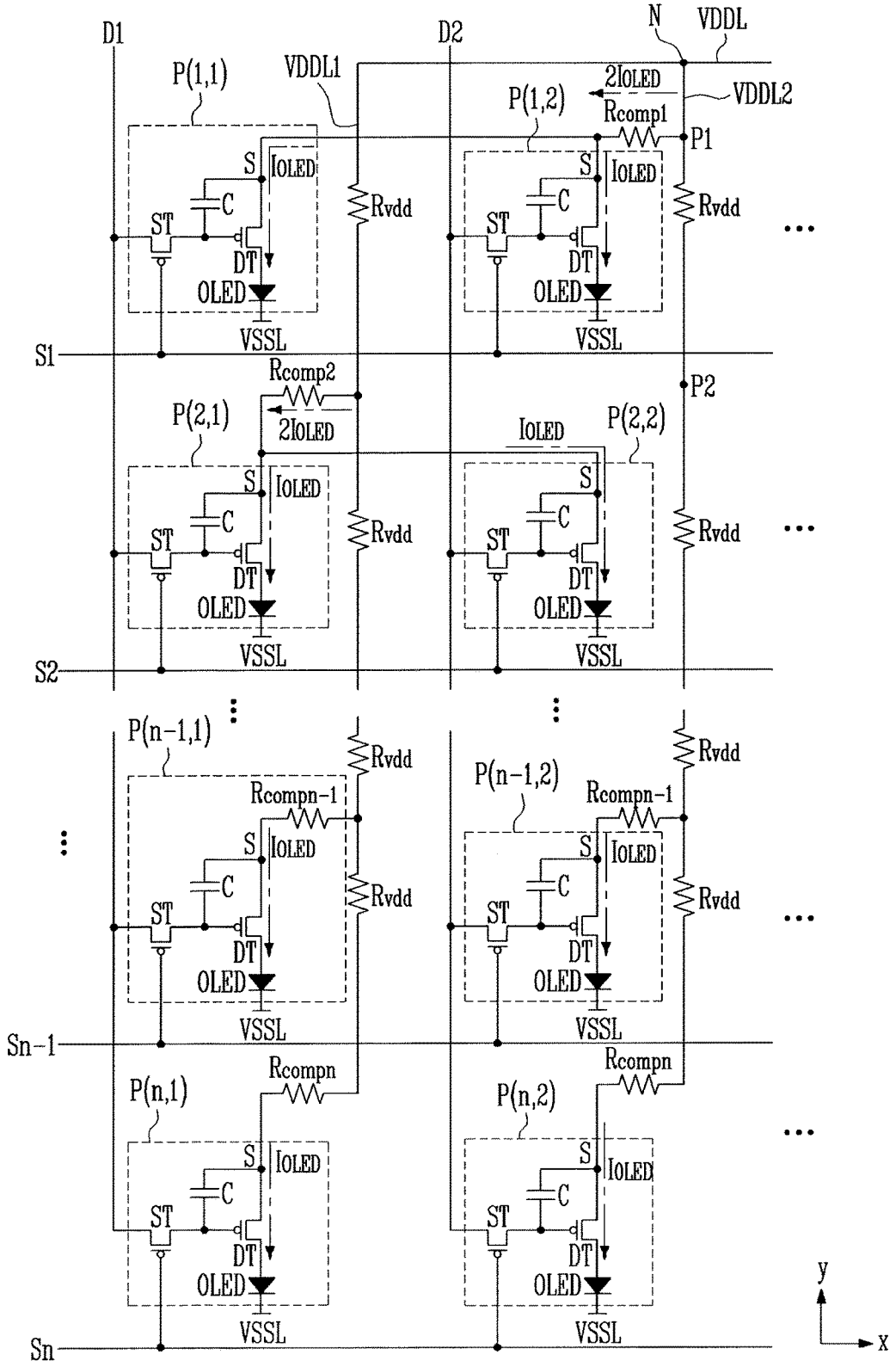
FIG. 5 illustrates a fourth embodiment of a display panel.

FIG. 5 illustrates a fourth embodiment of a display panel. For convenience of description, FIG. 5 shows only first, second, (n−1)-th and n-th scan lines S1, S2, Sn−1 and Sn, first and second data lines D1 and D2, a power voltage line VDDL branching into first power voltage lines VDDL1 and VDDL2 at node N, and first, second, (n−1)-th and n-th compensation resistances Rcomp1, Rcomp2, Rcompn−1 and Rcompn, and pixels P.

The first, second, (n−1)-th and n-th scan lines S1, S2, Sn−1 and Sn, the first and second data lines D1 and D2, the first power voltage lines VDDL1 and VDDL2, and the pixels P according to the fourth embodiment may be the same as the first, second, (n−1)-th and n-th scan lines S1, S2, Sn−1 and Sn, the first and second data lines D1 and D2, the first power voltage lines VDDL1 and VDDL2, and the pixels P according to the first embodiment.

Some of the compensation resistances Rcomp1, Rcomp2, Rcompn−1 and Rcompn are coupled between multiple pixels P and the first power voltage line VDDL. For example, each of the first and second compensation resistances Rcomp1 and Rcomp2 coupled near the start point of corresponding ones of the first power voltage lines VDDL1 and VDDL2 is coupled between the two pixels P and the corresponding first power voltage lines VDDL1 and VDDL2.

The (n−1)-th and n-th compensation resistances Rcompn−1 and Rcompn coupled nearer to the end points of the first power voltage lines VDDL1 and VDDL2 is coupled between one pixel P and the first power voltage lines VDDL1 and VDDL2. The first and second compensation resistances Rcomp1 and Rcomp2 coupled to be near the start point of the first power voltage lines VDDL1 and VDDL2 are coupled to the first electrodes (source nodes S) of the driving transistors of the s pixels P.

Thus, points nearer to the start points of the first power voltage lines VDDL1 and VDDL2 have larger compensation resistance to compensate for IR drops of the first power voltage. Hence, the fourth embodiment is advantageous in that each of the compensation resistances Rcomp1 and Rcomp2 coupled nearer to the start point of a respective one of the first power voltage lines VDDL2 and VDDL1 is coupled between multiple pixels P and the respective first power voltage line VDDL2 or VDDL1. Thus, an area sufficient for forming the compensation resistance may be obtained.

Conversely, points nearer to the end point of the first power voltage lines VDDL1 and VDDL2 have smaller compensation resistances to compensate for IR drops of the first power voltage. Thus, the fourth embodiment may sufficiently cover an area for forming the compensation resistance, even though each of the compensation resistances Rcompn−1 and Rcompn coupled to the end point of a respective one of the first power voltage lines VDDL2 and VDDL1 are coupled between the one pixel P and the respective first power voltage line VDDL2 or VDDL1.

In the fourth embodiment, each of the compensation resistances Rcomp1 and Rcomp2 coupled to be nearer to the start point of respective ones of the first power voltage lines VDDL2 and VDDL1 have been indicated to be coupled between multiple pixels P adjacent to each other in the first direction (x-axis direction) and the first power voltage line VDDL. In other embodiments, each of the compensation resistances Rcomp1 and Rcomp2 coupled nearer to the start point of respective ones of the first power voltage lines VDDL2 and VDDL1 may be coupled between multiple pixels P adjacent to each other in the second direction (y-axis direction) as shown in FIG. 3 and the respective first power voltage line VDDL2 or VDDL1, or may be coupled between the s pixels P forming the rectangular shape as shown in FIG. 4 and the respective first power voltage line VDDL2 or VDDL1.

Figure 6:
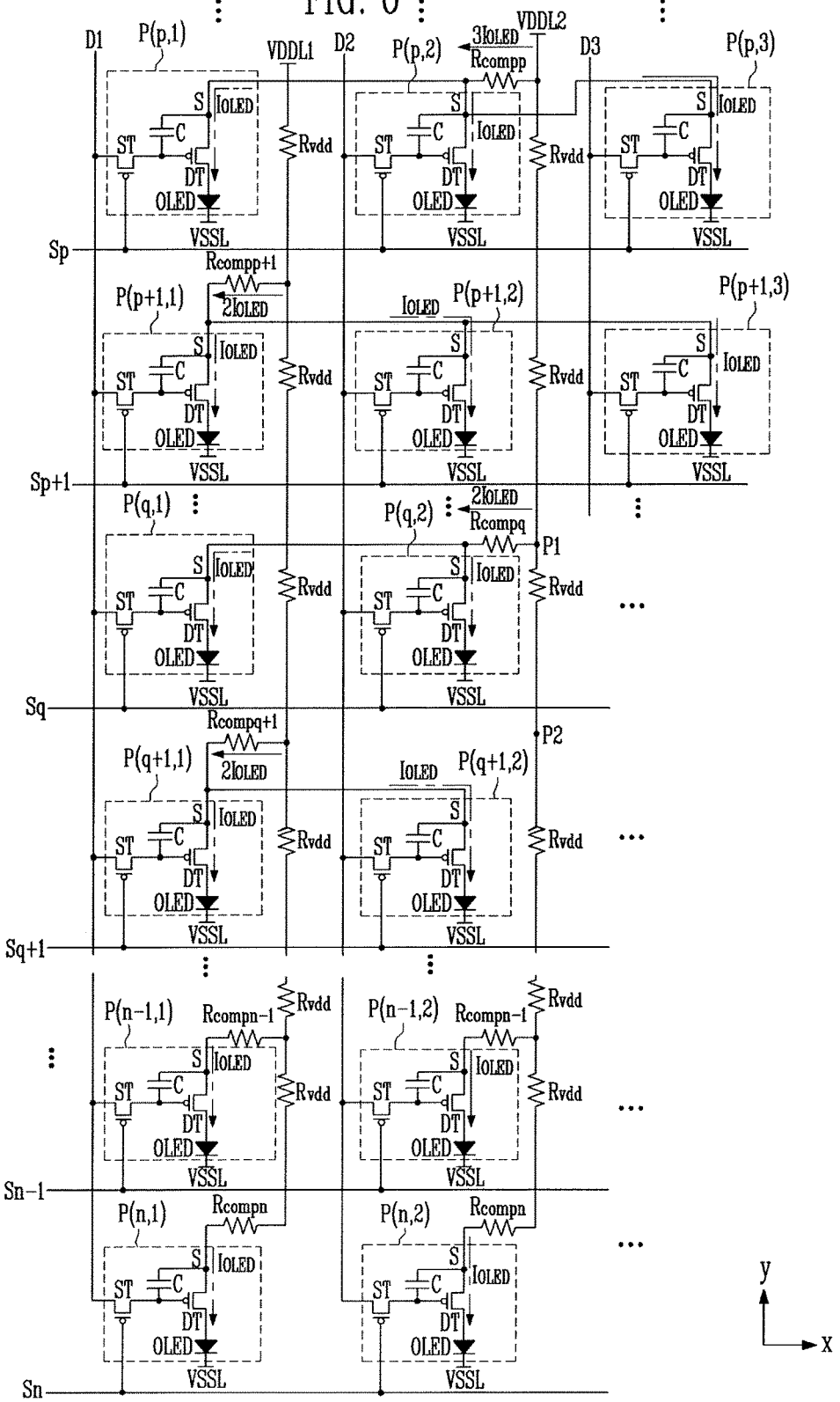
FIG. 6 illustrates a fifth embodiment of a display panel.

FIG. 6 illustrates a fifth embodiment of a display panel. For convenience of description, FIG. 6 shows only a pth, p+1th, qth, q+1th, (n−1)-th and n-th scan lines Sp, Sp+1, Sq, Sq+1, Sn−1 and Sn, first and second data lines D1 and D2, first power voltage lines VDDL1 and VDDL2, a pth, p+1th, qth, q+1th, (n−1)-th and n-th compensation resistances Rcompp, Rcompp+1, Rcompq, Rcompq+1, Rcompn−1 and Rcompn, and pixels P.

The pth (p is a positive integer satisfying the following relation, $1 \le p < q-1$), p+1th, qth (q is a positive integer satisfying the following relation, $p+1 < q < n-2$), q+1th, (n−1)-th and n-th scan lines Sp, Sp+1, Sq, Sq+1, Sn−1 and Sn, the first and second data lines D1 and D2, the first power voltage lines VDDL1 and VDDL2 and the pixel P according to the fifth embodiment may be the same as to the first, second, (n−1)-th and n-th scan lines S1, S2, Sn−1 and Sn, the first and second data lines D1 and D2, the first power voltage lines VDDL1 and VDDL2, and the pixel P according to the first embodiment.

Referring to FIG. 6, points nearer to the start points (e.g., power supply unit 50) of the first power voltage lines VDDL1 and VDDL2 have a greater number of pixels coupled to the compensation resistance. Points nearer the end points of the first power voltage lines VDDL1 and VADDDL2 have a fewer number of pixels coupled to the compensation resistance.

For example, as shown in FIG. 6, each of the p-th and p+1-th compensation resistances Rcompp and Rcompp+1 coupled near the start points of respective ones of the first power voltage lines VDDL2 and VDDL1 are coupled between the three pixels P and the respective first power voltage lines VDDL2 and VDDLL1. Further, as shown in FIG. 6, each of the (n−1)-th and n-th compensation resistances Rcompn−1 and Rcompn coupled near end points of the first power voltage lines VDDL1 and VDDL2 are coupled between one pixel P and the first power voltage lines VDDL1 and VDDL2.

Further, as shown in FIG. 6, each of the qth and q+1th compensation resistances Rcompq and Rcompq+1 formed between the pth and p+1th compensation resistances Rcompp and Rcompp+1 and the (n−1)-th and n-th compensation resistances Rcompn−1 and Rcompn are coupled between the two pixels P and respective ones of first power voltage lines VDDL2 and VDDL1. Here, each of the compensation resistances Rcompp, Rcompp+1, Rcompq and Rcompq+1 coupled to the two or three pixels P is coupled to the first electrodes (source node S) of the driving transistors of the s pixels P.

Points nearer to the start points of the first power voltage lines have larger compensation resistance to compensate for IR drops of the first power voltage. Thus, according to the fifth embodiment, points nearer to the start points of the first power voltage lines have a greater number of pixels coupled to the compensation resistance. Conversely, points nearer to the end point of the first power voltage lines VDDL have a fewer number of pixels coupled to the compensation resistance. Therefore, the fifth embodiment may provide an area sufficient for forming the compensation resistance.

It is described above that each of the pth, p+1th, qth and q+1th compensation resistances Rcompp, Rcompp+1, Rcompq and Rcompq+1 is coupled between the pixels P adjacent to each other in the first direction (x-axis direction) and the first power voltage lines VDDL1 and VDDL2. In other embodiments, each of the pth, p+1th, qth and q+1th compensation resistances Rcompp, Rcompp+1, Rcompq and Rcompq+1 may be coupled between the pixels P adjacent to each other in the second direction (y-axis direction)

as shown in FIG. 3 and the first power voltage lines VDDL1 and VDDL2, or may be coupled between the pixels P forming the rectangular shape as shown in FIG. 4 and the first power voltage lines VDDL1 and VDDL2.

Figure 7:
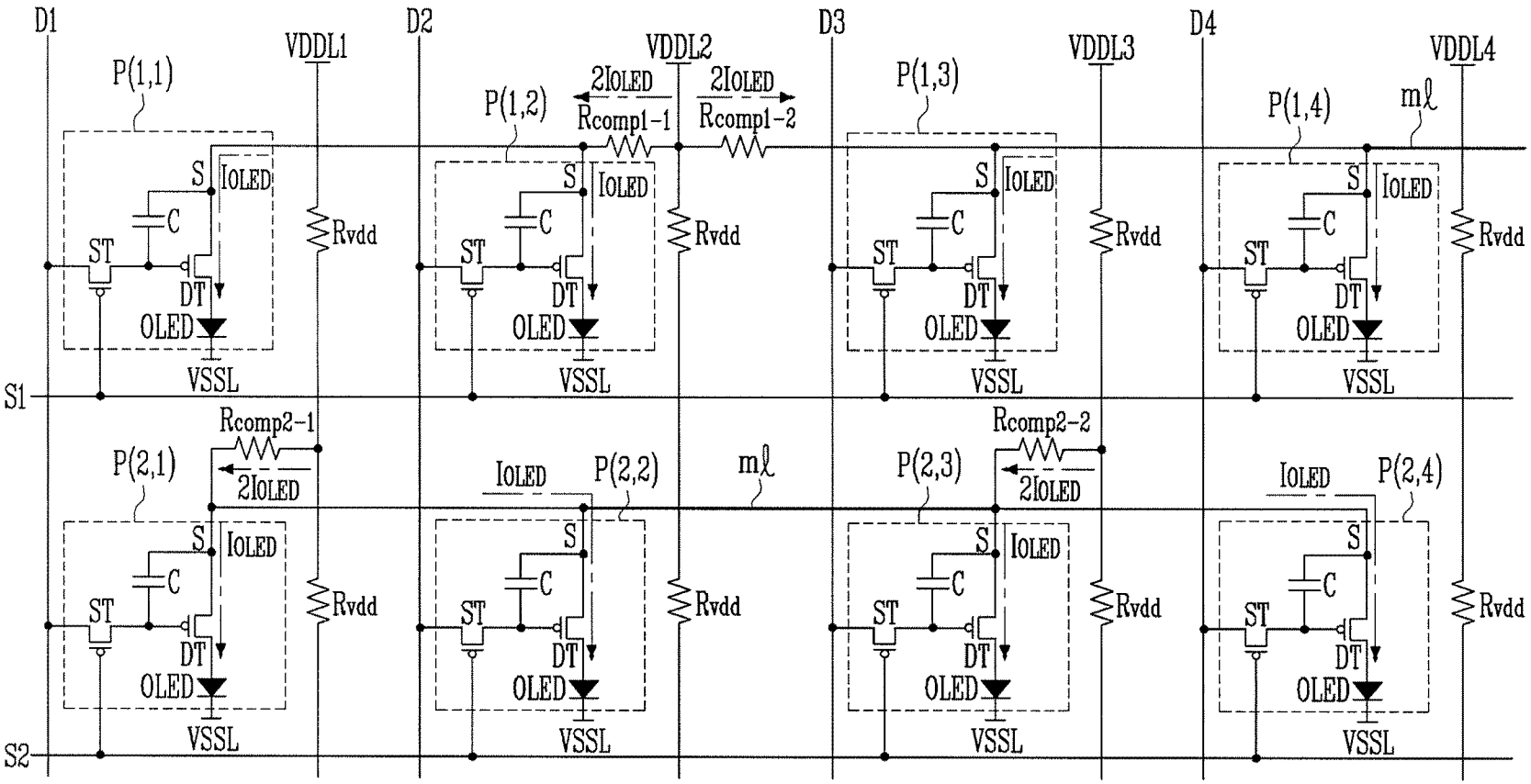
FIG. 7 illustrates a sixth embodiment of a display panel.

FIG. 7 illustrates a sixth embodiment of a display panel. For convenience of description, FIG. 7 shows only first and second scan lines S1 and S2, first to fourth data lines D1, D2, D3 and D4, first power voltage lines VDDL1, VDDL2, VDDL3, and VDDL4, and (1-1)-th, (1-2)-th, (2-1)-th and (2-2)-th compensation resistances Rcomp1-1, Rcomp1-2, Rcomp2-1 and Rcomp2-2, and pixels P.

The first and second scan lines S1 and S2, the first to fourth data lines D1, D2, D3 and D4, the first power voltage lines VDDL1 and VDDL2, the first and second compensation resistances Rcomp1 and Rcomp2, and the pixels P according to the sixth embodiment may be the same as the first, second, (n−1)-th and n-th scan lines S1, S2, Sn−1 and Sn, the first and second data lines D1 and D2, the first power voltage lines, the first, second, (n−1)-th and n-th compensation resistances Rcomp1, Rcomp2, Rcompn−1 and Rcompn, and the pixels P according to the first embodiment.

However, according to the sixth embodiment, the source nodes S of the s pixels coupled to any one of the compensation resistances are coupled to the source nodes S of the s pixels coupled to a compensation resistance adjacent to the above-mentioned compensation resistance, using a mesh line m1. For example, as shown in FIG. 7, the source nodes S of the two pixels P(2,1) and P(2,2) coupled to the (2-1)-th compensation resistance Rcomp2-1 may be coupled to the source nodes S of the two pixels P(2,3) and P(2,4) coupled to the (2-2)-th compensation resistance Rcomp2-2, via the mesh line m1.

In this case, the voltage of the source nodes S of the two pixels P(2,1) and P(2,2) coupled to the (2-1)-th compensation resistance Rcomp2-1 may be substantially equal to the voltage of the source nodes S of the two pixels P(2,3) and P(2,4) coupled to the (2-2)-th compensation resistance Rcomp2-2. Thus, the sixth embodiment may further reduce non-uniformity of the luminance between the s pixels coupled to any one of the compensation resistances and the s pixels coupled to the compensation resistance adjacent to the above-mentioned compensation resistance.

It is described above that each of the (1-1)-th, (1-2)-th, (2-1)-th and (2-2)-th compensation resistances Rcomp1-1, Rcomp1-2, Rcomp2-1 and Rcomp2-2 is coupled between the pixels P adjacent to each other in the first direction (x-axis direction) and the first power voltage lines. In other embodiments, each of the (1-1)-th, (1-2)-th, (2-1)-th and (2-2)-th compensation resistances Rcomp1-1, Rcomp1-2, Rcomp2-1 and Rcomp2-2 may be coupled between the pixels P adjacent to each other in the second direction (y-axis direction) as shown in FIG. 3 and the first power voltage lines, or may be coupled between the pixels P forming the rectangular shape as shown in FIG. 4 and the first power voltage lines.

By way of summation and review, in accordance with one or more of the aforementioned embodiments, the compensation resistance between the pixels and the first power voltage line prevent the voltage of the source electrode of the driving transistor of each of the pixels from being changed due to the IR drop of the first power voltage. For example, points nearer to the start point of a first power voltage line have larger compensation resistances. This may reduce or prevent luminance of the pixels from being non-uniform due to the IR drop of the first power voltage.

Further, the compensation resistance may be formed between the s pixels and the first power voltage line, to thereby form compensation resistance within the area of the s pixels. Therefore, the compensation resistance per unit pixel may be reduced, to thereby allow the pixel P to be easily implemented even when the display device is formed to have high resolution.

Further, the source nodes of the s pixels coupled to any one of the compensation resistances to the source nodes of the s pixels may be coupled to the compensation resistance adjacent to the above-mentioned compensation resistance using the mesh line. Therefore, the non-uniformity of luminance may be further reduced between the s pixels coupled to any one of the compensation resistances and the s pixels coupled to the compensation resistance adjacent to the above-mentioned compensation resistance. The contact resistances in the aforementioned embodiments are shown to be resistors. In other embodiments, another resistive element may be used in place of or with a resistor to form the contact resistances.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a display panel including power voltage lines and pixels coupled to data lines and scan lines;

a data driver to supply data voltages to the data lines;

a scan driver to provide scan signals to the scan lines; and a power supply to supply a power voltage to the power voltage lines, wherein the display panel includes a compensation resistance coupled between s pixels and one of the power voltage lines, where s≥2, and wherein:

a point nearer to a start point of the one of the power voltage lines has a first number of the pixels coupled to the compensation resistance, a point nearer to an end point of the power voltage line has a second number of the pixels coupled to the compensation resistance, and the first number is greater than the second number.

2. The device as claimed in claim 1, wherein each of the pixels includes:

a driving transistor to control current from a first electrode to a second electrode depending on a voltage of a control electrode;

a scan transistor to turn on in response to the scan signal of each of the scan lines, and to supply the data voltage of each of the data lines to the control electrode of the driving transistor;

an organic light emitting diode to emit light depending on a current controlled by the driving transistor; and a capacitor coupled between the control electrode of the driving transistor and the first electrode.

3. The device as claimed in claim 2, wherein the compensation resistance is coupled between the one of the power voltage lines and the first electrode of the driving transistor in each of the s pixels.

4. The device as claimed in claim 1, wherein the s pixels are adjacent to each other in a first direction of the scan lines.

5. The device as claimed in claim 4, wherein compensation resistances adjacent to each other in a second direction of the data lines are coupled to different ones of the power voltage lines.

6. The device as claimed in claim 1, wherein the s pixels are adjacent to each other in a second direction of the data lines.

7. The device as claimed in claim 6, wherein compensation resistances adjacent to each other in a first direction of the scan lines are coupled to different ones of the power voltage lines.

8. The device as claimed in claim 1, wherein the s pixels include:

pixels adjacent to each other in a first direction of the scan lines; and pixels adjacent to each other in a second direction of the data lines.

9. The device as claimed in claim 8, wherein the s pixels are arranged in a substantially rectangular shape.

10. The device as claimed in claim 1, wherein a predetermined number of compensation resistances are coupled between corresponding ones of a plurality of groups of s pixels and corresponding ones of power voltage lines, and wherein the predetermined number is less than all the compensation resistances.

11. The device as claimed in claim 10, wherein:

compensation resistances nearer to start points of the power voltage lines are coupled between corresponding ones of the groups of s pixels and corresponding ones of the power voltage lines, and each of the compensation resistances nearer to end points of the power voltage lines is coupled between one pixel and a corresponding one of the first power voltage lines.

12. The device as claimed in claim 1, further comprising:

a mesh line connecting first electrodes of driving transistors of the s pixels coupled to the compensation resistance to first electrodes of driving transistors of s pixels coupled to another compensation resistance.

13. A display device, comprising:

a power line;

a first number of pixels;

a second number of pixels;

a first compensation resistance coupled between a light emitter of each of the first number of pixels and the power line; and a second compensation resistance coupled between a light emitter of each of the second number of pixels and the power line, wherein the first compensation resistance is greater than the second compensation resistance, wherein the second compensation resistance is farther away from a start point of the power line than the first compensation resistance, and wherein the first number of pixels is different from the second number of pixels.

14. The display device as claimed in claim 13, wherein a voltage of an output terminal of the first compensation resistance is substantially equal to a voltage of an output terminal of the second compensation resistance.

15. The display device as claimed in claim 13, wherein the first and second numbers of pixels are in a same row.

16. The display device as claimed in claim 13, wherein the first and second numbers of pixels are in a same column.

17. The display device as claimed in claim 13, wherein a same current flows through the first and second compensation resistances.

18. The display device as claimed in claim 13, wherein each of the first and second compensation resistances include at least one resistor.

* * * * *